US006755141B2

(12) United States Patent
Musco et al.

(10) Patent No.: US 6,755,141 B2
(45) Date of Patent: Jun. 29, 2004

(54) METHOD FOR STITCHING A WORK PIECE USING A COMPUTER CONTROLLED, VISION-AIDED SEWING MACHINE

(75) Inventors: Richard G. Musco, Lake Worth, FL (US); Howard L. Shaffer, Hillsboro Beach, FL (US)

(73) Assignee: Otabo LLC, Pompano Beach, FL (US)

( * ) Notice: Subject to any disclaimer, the term of this patent is extended or adjusted under 35 U.S.C. 154(b) by 68 days.

(21) Appl. No.: 10/079,941

(22) Filed: Feb. 19, 2002

(65) Prior Publication Data

US 2002/0157588 A1 Oct. 31, 2002

Related U.S. Application Data

(63) Continuation-in-part of application No. 09/825,668, filed on Apr. 3, 2001, now Pat. No. 6,367,397.

(51) Int. Cl.[7] ..... D05B 21/00

(52) U.S. Cl. ..... 112/475.05; 112/470.07; 12/142 R

(58) Field of Search ..... 112/475.05, 470.07, 112/475.19, 475.03, 470.01, 470.04, 470.06, 102.5; 700/138, 136, 137; 12/142 R, 142 LC, 146 R, 146 L

(56) References Cited

U.S. PATENT DOCUMENTS

| | | | | |
|---|---|---|---|---|
| 4,072,114 | A | | 2/1978 | Sugiyama et al. |
| 4,312,282 | A | | 1/1982 | Dorosz et al. |
| 4,498,404 | A | | 2/1985 | Sadeh |
| 4,639,964 | A | | 2/1987 | Binder |
| 4,655,149 | A | | 4/1987 | Szydlek |
| 4,784,071 | A | | 11/1988 | Sadeh et al. |
| 4,817,222 | A | | 4/1989 | Shafir |
| 4,821,657 | A | | 4/1989 | Herdeg et al. |
| 4,821,662 | A | | 4/1989 | Pongrass et al. |
| 4,834,008 | A | | 5/1989 | Sadeh et al. |
| 4,932,343 | A | | 6/1990 | Mardix et al. |
| 4,934,292 | A | | 6/1990 | Mardix et al. |
| 5,094,538 | A | | 3/1992 | Reedman et al. |
| 5,205,232 | A | | 4/1993 | Sadeh et al. |
| 5,259,329 | A | | 11/1993 | Reedman et al. |
| 5,323,722 | A | | 6/1994 | Goto et al. |
| 5,481,467 | A | | 1/1996 | Smith et al. |
| 5,537,939 | A | | 7/1996 | Horton |
| 5,537,946 | A | | 7/1996 | Sadeh et al. |
| 5,777,880 | A | | 7/1998 | Bowen et al. |
| 5,790,687 | A | * | 8/1998 | McLaughlin et al. ..... 112/470.06 X |
| 6,032,860 | A | | 3/2000 | Brian |
| 6,216,619 | B1 | | 4/2001 | Musco et al. |
| 6,367,397 | B1 | | 4/2002 | Musco et al. |

FOREIGN PATENT DOCUMENTS

| | | |
|---|---|---|
| EP | 0 221 163 B1 | 9/1990 |
| WO | WO 86/06423 | 11/1986 |

* cited by examiner

*Primary Examiner*—Peter Nerbun
(74) *Attorney, Agent, or Firm*—Townsend and Townsend and Crew LLP

(57) ABSTRACT

A method of stitching one work piece to another or for stitching a decorative stitch line along a work piece. In one embodiment the method includes providing a first work piece having a first edge along which a stitch is to be made and providing a template having an edge that corresponds generally to at least a portion the first edge of the first work piece. The template is made from a material having a color selected to contrast with a color of the first work piece. The first work piece is then placed against the template so that the work piece's first edge abuts at least a portion of the edge of the template. Next, a computer-controlled sewing machine that has a machine-vision capability is used to stitch along a path that corresponds generally to a boundary between the first edge of the first work piece and the edge of the template. If necessary or appropriate, the computer-controlled sewing machine can adjust its stitching path in response to detecting the template. Then, after stitching is completed, the first work piece is separated from the template.

25 Claims, 5 Drawing Sheets

METHOD FOR STITCHING A WORK PIECE USING A COMPUTER CONTROLLED, VISION-AIDED SEWING MACHINE

CROSS-REFERENCES TO RELATED APPLICATIONS

This application is a continuation-in-part of U.S. application Ser. No. 09/825,668 U.S. Pat. No. 6,367,397 entitled "A METHOD FOR STITCHING A WORK PIECE USING A COMPUTER CONTROLLED, VISION-AIDED SEWING MACHINE", filed on Apr. 3, 2001 and listing Richard G. Musco and Howard L. Shaffer as coinventors. The disclosure of which is hereby incorporated herein by reference in its entirety.

BACKGROUND OF THE INVENTION

The present invention relates to a computerized manufacturing process. More specifically, the present invention relates to a computerized method that enables work pieces, e.g., parts of a shoe upper, to be accurately sewn together and to be sewn with decorative stitching lines, in a vision-aided, computer-guided process.

Traditional shoemaking techniques use a last, which is a solid form, over which a shoe will be made. The last looks somewhat like a foot, but without the toes and other such detail. Traditionally, lasts are hand crafted out of wood by a last "model maker" and then duplicated in volume, including grading for different sizes, on a special lathe, set up specifically for cutting lasts. A different size last (actually a pair of lasts, one for each foot) is needed for each size of shoe. Thus, a line of shoes that is available in half sizes 5–12 and widths narrow, medium, wide for each size, would require 45 pairs of lasts.

From each last, a shoemaker derives a set of paper patterns for each style of shoe to be made. One traditional way of deriving the paper patters is to cover the model size of a last (e.g., a size 9, medium last for men) with narrow (e.g., ½" wide) strips of tape. Once the last surface is completely covered with tape, the shoemaker would then sketch the shoe on the taped surface, showing all details of the shoe. The tape can then be peeled from the last surface in two halves by first cutting down the centerline of the last (toe to heel) and then laying it flat on a flat surface. The two halves are "joined" along their centerlines in the forefoot area.

This flattened tape is called a flattening and is a mechanical way of taking the 3-D surface of the last and translating it to a 2-D surface. The lines of the shoe on the 3-D surface are also shown on this flattening. From these lines, the shoemaker is able to layout all the patterns of the pieces to be cut (from leather and other materials) which will later be sewn together to make up the upper of the shoe. Typically the shoemaker cuts the pieces out of a heavy paper, thus making a set of paper patterns.

Paper patterns not only show the outline of the pieces to be cut, but all the details necessary to aid in production. This includes any perforations (eyelet holes, for example) or markers. A marker is a slot cut in a paper pattern to indicate the position of lines for stitching or guidance in placement of one part on top of another. From the finished set of paper patterns (including all sizes), a shoemaker can make the necessary cutting dies (normally made from band steel) and other templates and tools needed for production.

This shoemaking process has been in use pretty much unchanged since the beginning of the last century. Only in the past two decades have there been significant efforts and advances in some of these processes. For one, with the advent of computer driven CAD/CAM systems specific to the footwear industry, much of the pattern work is now done by computer instead of by hand. Paper patterns output from computer CAD/CAM systems can be plotted or cut on computer-guided tables, and these patterns used as guides for making steel cutting dies and the other templates and tools necessary for production.

Another area where progress has been made is through the use of computer-guided sewing machines. For example, computerized stitching or sewing machines can be employed to sew various pieces of a shoe together. Some computerized stitching machines perform sewing operations along a predetermined path using a sewing program stored in a computer-readable medium. A major drawback to most of these machines is that they are blind, i.e., they cannot see the work piece being sewn. Leather and textiles, basic work pieces in the manufacture of shoes, are flexible materials that may change size and position before and during the sewing process. Thus, occasionally the predetermined sewing path does not match the actual path being sewn resulting in pieces that are subsequently rejected during quality control inspections.

In order to overcome these deficiencies, companies have developed computerized sewing machines with "machine vision" that detects the edges of the work piece being sewn. These machine-vision sewing machines include the use of cameras and illuminating lights to detect and enhance the detection respectively of the edge of a work piece. With the edge of the work piece identified, the computer controller within the sewing machine can adjust the sewing path as necessary to compensate for misplacement or movement of the work piece or other variations that may otherwise lead to an erroneous sewing path. Edge detection is a complicated process, however, and slight variations in the lighting conditions, work piece characteristics (e.g., color of the leather) or other factors may cause the edge detection software to not function properly. Thus, set up time for an edge detecting machine vision sewing system is lengthy and changes in the work environment may require subsequent adjustments to the machine set up.

The traditional shoe manufacturing techniques described above are well suited for mass production, where long and tedious set-up procedures can be spread out over large production runs for large quantities of shoes with a limited number of sizes. They are not so well suited for the manufacture of custom shoes, where production can be done on a pair-by-pair basis, or at least for much smaller quantities than found in normal mass production. Typically, custom shoes are handmade, relying on skilled artisans and taking several weeks or more to manufacture.

Accordingly, improved shoe manufacturing techniques and equipment are desirable as is an improved method of manufacturing custom shoes.

BRIEF SUMMARY OF THE INVENTION

Embodiments of the present invention provide improved shoe manufacturing techniques including a new method of operating a computerized, vision-aided sewing apparatus. The invention can be used to stitch one or more work pieces together and/or for stitching decorative stitch lines along a work piece.

In one embodiment for stitching a work piece the method includes providing a first work piece having a first edge along which a stitch is to be made and providing a template having an edge that corresponds generally to at least a portion the first edge of the first work piece. The template is made from a material having a color selected to contrast with a color of the first work piece. The first work piece is then placed against the template so that the work piece's first edge abuts at least a portion of the edge of the template. Next, a computer-controlled sewing machine that has a machine-vision capability is used to stitch along a path that corresponds generally to a boundary between the first edge of the first work piece and the edge of the template. If appropriate, the computer-controlled sewing machine can adjust its stitching path in response to detecting the template. Then, after stitching is completed, the first work piece is separated from the template.

In another embodiment for stitching a first work piece to a second work piece the method includes arranging the second work piece on a pallet. Next, the first work piece and a template made from a material having a color that contrasts with a color of the first work piece are arranged over the pallet so at least a portion of the first work piece overlies the second work piece and so that an edge of the template overlies or abuts at least a portion of the first work piece in an area corresponding to a desired stitching path. The pallet is then transferred to a computer-controlled, machine-vision sewing machine and the first work piece is stitched to the second work piece along the desired stitching path using the sewing machine's vision capabilities to detect a boundary between the edge of the template and the first work piece. If appropriate, the computer-controlled sewing machine can adjust its stitching path in response to the detected boundary. Then, after stitching is completed, the first and second work pieces that are now stitched together are separated from the pallet and the template.

In still another embodiment, a process for manufacturing shoes is disclosed. The process includes using a computer-controlled apparatus to cut first and second work pieces from a first piece of material of a first color according to a predetermined pattern stored in a computer-readable medium. Using a computer-controlled apparatus to cut a pallet that includes one or more appropriately placed openings that allow for stitching and to plot alignment marks on the pallet for aligning work pieces to be stitched thereon, where the openings are cut and the alignment marks are drawn according to predetermined patterns stored in the computer-readable medium. And using a computer-controlled apparatus to cut a template from a second piece of material of a second color selected to contrast with the first color according to a predetermined pattern stored in the computer-readable medium, the template including at least one edge that corresponds generally to a desired stitching path. The first work piece is arranged over the pallet using the alignment marks so at least a portion of the first work piece overlies one of the openings. Next, the template is placed over the pallet and the second work piece is arranged over pallet so that an edge of the second work piece abuts at least a portion of the template edge. After the first and second work pieces and template are placed over the pallet, a computer-controlled sewing machine is used to stitch the second work piece to the first work piece along a programmed sewing path that corresponds generally to at least a portion of the template edge. The computerized sewing machine includes a machine-vision capability enabling it to adjust its sewing path in response to the boundary between the template and the second work piece. Finally, after the work pieces are stitched together, they are removed from the pallet and template and readied for the next step in the shoe manufacturing process.

In some embodiments, the machine-vision system for the stitching machine includes ultraviolet lamps to better illuminate the boundaries between the template and the work pieces.

Some embodiments of the invention are particularly useful for the manufacture of custom shoes, where many sizes of a given style of shoe (hundreds or even thousands of sizes), in production-run quantities as few as one half pair per size, can be stitched on a vision-aided computer stitching machine, with a minimum of set-up work required. Patterns output from a CAD/CAM system can include corresponding data to (i) cut and plot alignment lines on pallets used in the assembly of the shoes, (ii) cut the work pieces (shoe parts) to be stitched, (iii) cut the template used to guide the computer-controlled, machine-vision sewing system, and (iv) provide stitch line data for the sewing machine.

These embodiments and others are described more fully in the Detailed Description below in conjunction with the following figures.

DETAILED DESCRIPTION OF THE INVENTION

As stated above, embodiments of the invention pertain to new techniques of some a computer-controlled, machine-vision sewing system to stitch a work piece. In some embodiments, the work piece to be stitched is positioned on a pallet that can be loaded into an appropriate sewing system. In addition to the work piece, a template that is made from a material having a color that contrasts with the primary color of the work piece is also placed over the palate. The template and work piece are positioned with respect to each other in a manner where an edge of the template parallels or defines a desired stitching path on the work piece. Because of the contrasting colors, the machine-vision sewing system can detect the boundary between the template and the work piece and use this information to stitch the desired stitching path.

In some embodiments, the computer-controlled sewing system is pre-programmed with one or more predetermined stitching paths and uses its machine-vision system to adjust the predetermined stitching path with respect to the template as appropriate. In other embodiments, the computer controlled sewing system follows stitching commands (e.g., distances and general directions) rather than a predetermined stitching path. The system stitches thread along a path with respect to the template where the path is determined by referencing both the stitching commands and data representing the boundary between the template and work piece generated from the system's machine-vision system.

Embodiments of the invention can be used to stitch work pieces together and to add decorative stitching to a work piece. Also, some embodiments of the invention use ultraviolet lamps to increase the contrast between the template and the work piece(s) during the stitching operation. In order to better understand and appreciate the invention, an example of its use in the manufacture of custom shoes is described below. The example includes specific, exemplary work pieces (shown in FIG. 2), an exemplary pallet (shown in FIG. 3) and an exemplary template (shown in FIG. 4) for the manufacture of a black men's wingtip shoe. The use of these exemplary parts to assemble a portion of the wingtip shoe is discussed below with respect to FIGS. 1–9. It is to be understood that these exemplary parts are specific to the manufacture of this one particular shoe type. When used for the manufacture of other shoes or other applications, the work pieces, pallet and template may differ from what is shown in the following figures. Also, the description below of the invention with respect to the manufacture of shoes is for exemplary purposes only, the invention can be used for other applications.

Figure 1:
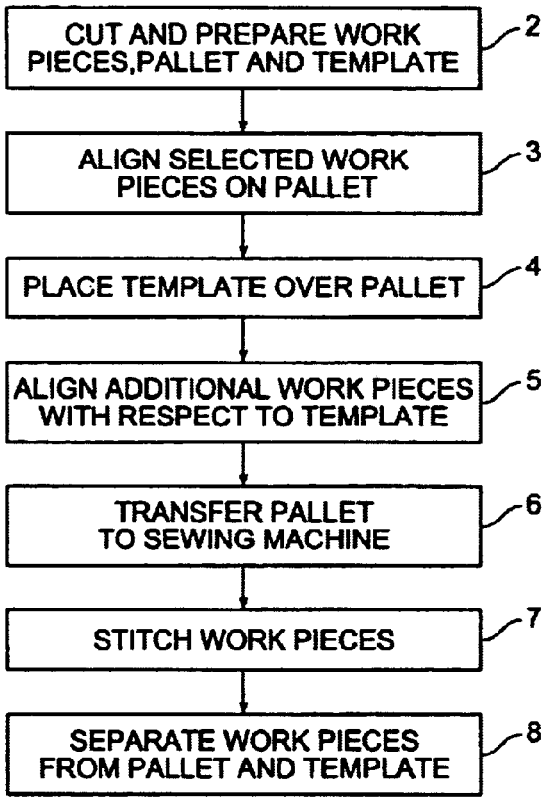
FIG. 1 is a flowchart illustrating one embodiment of the method of the present invention.

FIG. 1 is a flowchart showing one embodiment of a computer controlled stitching method (steps 2–8) according to the present invention as implemented in a method of manufacturing custom shoes. As shown in FIG. 1, prior to the stitching operation, various parts, including work pieces, the pallet and the template are cut from appropriate material (step 2). The work pieces are cut from material that is selected based upon the desired end product. For example, if the end product is a black leather wingtip shoe, the work pieces are cut from a piece of black leather. The pallet may be prepared from a piece of cardboard or similar material and the template is prepared from a material that has a color selected to contrast with the primary color of the work piece material. For example, if the work piece material is dark (brown, black, blue, etc.), the template may be cut from a piece of white material, e.g., bleached cardboard or posterboard. Similarly, if the work piece material is light (white, yellow, pink, etc.), the templates may be cut from a piece of black material, e.g., dark cardboard or posterboard. Step 2 may also included plotting alignment lines on the pallet, cutting windows in both the pallet and the template, punching holes, shaving and skiving the work pieces, and other appropriate preparatory steps as described in more detail below.

In one specific embodiment, the cutting of step 2 (and plotting as appropriate) is performed at a computer-controlled cutting table, such as a Model LC1800 manufactured by Zund Corporation and cutting data that controls the cutting table is generated from a digitally created pattern stored in a computer-readable medium such as a hard disk drive. As previously mentioned, custom shoe manufacturing may use hundreds or even thousands of different sizes (and thus patterns) to produce shoes that have a more exacting fit for an individual wearer than mass produced shoes. (Mass produced shoes typically use at least an order of magnitude fewer sizes and more typically only between about 15–45 sizes for men's casual and dress shoes.) Thus, rather than have steel cutting dies made for each size of a style of shoe from a set of paper patterns produced for each size of last, some embodiments of the present invention use digitally-stored, computer-generated patterns to guide the operation of the cutter. In this manner, work pieces can be cut with a very high degree of accuracy.

In one embodiment the digital patterns are created from input files that represent a three-dimensional digital representation of lasts ("digital lasts") created in a CAD/CAM system for each size of the custom shoes. For a typical custom shoe line there may be over 1000 different sizes thus requiring over 1000 digitized lasts. The digital patterns, one set for each digital last, are created from these three dimensional digital lasts using mathematical flattening algorithms as is known to those of skill in the art. When an individual's foot is digitized it can be compared to the three dimensional digital lasts using a best fit analysis to determine the set of digital patterns that should be referenced by the cutter during step 2. Once a match is determined, the patterns for the matching last can be downloaded to the cutter to create an appropriate pallet and cut the necessary work pieces and templates. This process eliminates the need to make steel cutting dies that are otherwise required to cut the work pieces and results in more accurate cuts and more accurate plotted lines than is possible with cutting dies.

The LC1800 cutting table is equipped with over head projectors that project the patterns onto a piece of material prior to the actual cutting operation. This allows an operator to move the projected parts with an input device such as a mouse to avoid including scratches, scars or other defects in the material within the work pieces. The operator also may move the projected parts in order to get the best yield from a given piece of material. The cutting head of the Zund LC1800 plotting/cutting table includes four (4) separate tools: an oscillating knife that cuts the material; a pen that plots lines; and two routers that punch different size holes in the material for alignment and/or for decorative purposes. Having four tools on this table enables the table to plot lines and cut work pieces from the same set of digital patterns as part of a single continuous operation.

Figure 2:
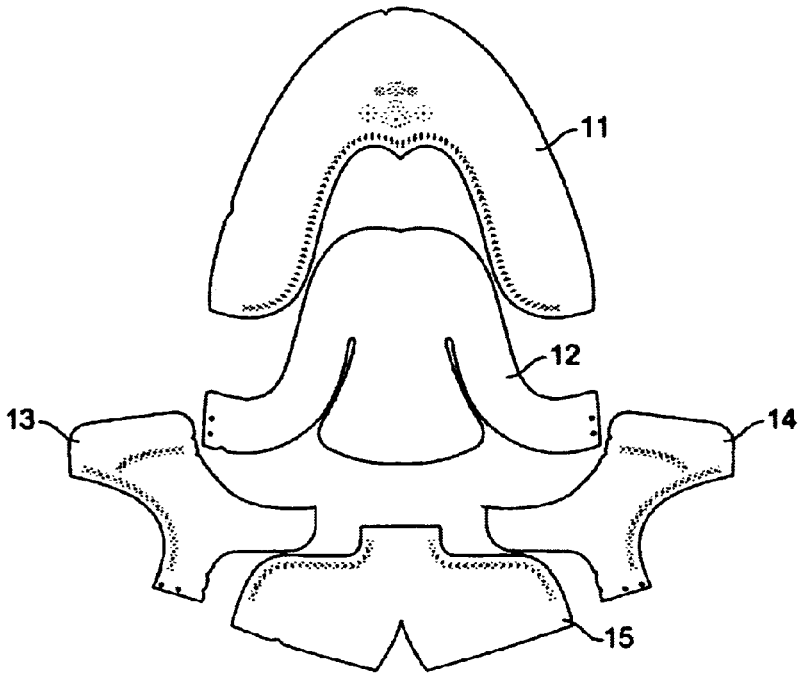
FIG. 2 shows various work pieces that are to be stitched together to form a portion of a shoe according to one exemplary embodiment of the invention.
Figure 3:
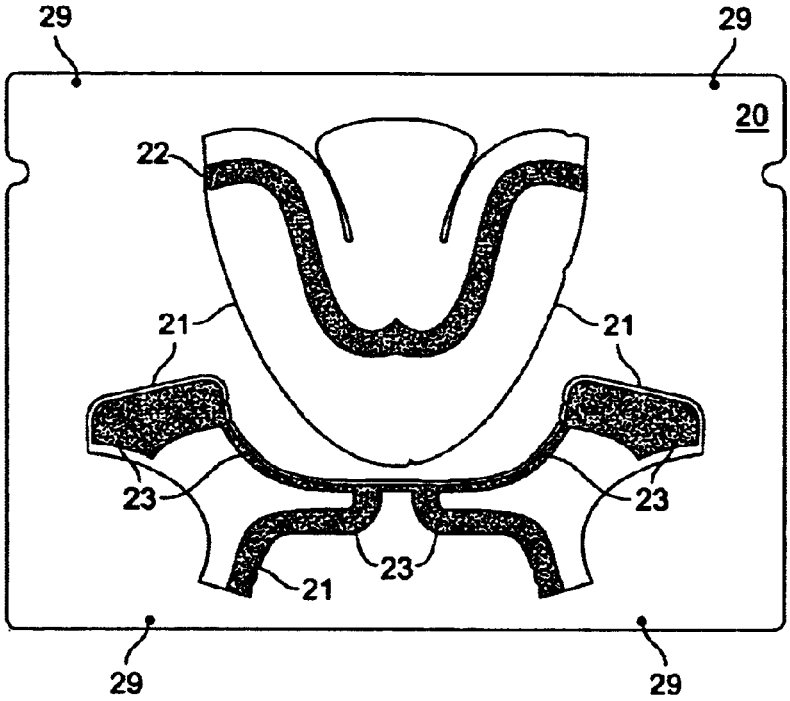
FIG. 3 is a top plan view of an exemplary pallet that may be used to facilitate the alignment of some of the work pieces shown in FIG. 2 prior to being stitched according to the method of the present invention.
Figure 4:
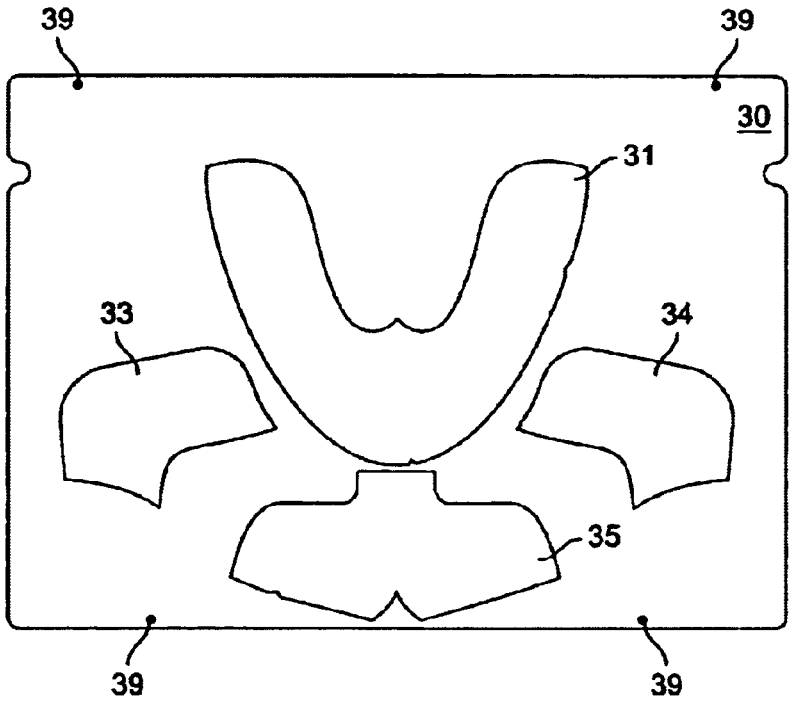
FIG. 4 is a top plan view of an exemplary template that may be used to facilitate alignment of the additional work pieces shown in FIG. 2 and as a guide a computer-controlled, machine-vision sewing system during the stitching process.

Before describing this example of one embodiment of the invention further, reference is made to FIGS. 2, 3 and 4, which show the work pieces, pallet and template that are prepared in FIG. 1, step 2. FIG. 2 is a top view of work pieces 11, 12, 13, 14 and 15, which represent the shoe tip, the vamp, the quarters, and the foxing, respectively, of the wingtip shoe. As shown in FIG. 2, some of work pieces 11–15 include decorative holes that were cut, for example, with the routers at the cutting table.

FIG. 3 is a top plan view of an exemplary pallet 20 that may be used to facilitate the alignment of the work pieces shown in FIG. 2 prior to the stitching process. Pallet 20 includes lines 21 that can be used to assist in positioning the cut work pieces on the pallet in preparation for stitching. Pallet 20 also includes windows 22 and 23 in areas where the work pieces will be stitched and four locating holes 29. In one embodiment lines 21 are plotted using the pen tool on the cutting table and windows 22 and 23 are cut from pallet 20 in the same manner that the work pieces are cut. Locating holes 29 are cut to align with four positioning pins when loading the pallet into the computer-controlled, machine-vision sewing machine.

Similarly, FIG. 4 is a top plan view of an exemplary template 30 used for positioning some parts on pallet 20 and for guiding the machine-vision sewing machine as described in detail below. Template 30 is a brightened or bleached white cardboard that can be clearly seen to contrast with the black work pieces 11–15. Template 30 includes four windows 31, 33, 34 and 35 that are cut from the interior of the template and four locating holes 39 that align with locating holes 29.

Referring back to FIG. 1, in one embodiment after the various work pieces are cut, each work piece is split on a special designed band saw to a predetermined thickness and then skived prior to being aligned on the pallet for stitching (still step 2). The skiving operation bevels the edges of the work pieces where they overlay another piece and can be done on commercially available computer-controlled machines such as a skiver manufactured by Fortuna, a German company. Typically the leather work pieces being stitched during the manufacture of shoes are split to a thickness of at least 1.0 mm, although the desired thickness is dependent upon the style of shoe and is not dictated by any stitching criteria or other requirements.

Next, the work pieces and template are ready to be positioned on the pallet. In the example of a wingtip shoe illustrated in FIGS. 2–9, the alignment of the parts and template is a three-step process where the first step includes positioning an initial, bottom layer of work pieces on pallet 20 (FIG. 1, step 3), the second step includes placing a template 30 over the pallet and bottom layer of work pieces (FIG. 1, step 4) and the third step includes positioning an upper layer of work pieces over the bottom layer using the template to properly align the upper work pieces (FIG. 1, step 5). These upper layer work pieces are to be stitched to the lower layer work pieces in areas where the upper work pieces overlie the lower ones. A person of skill in the art will recognize that the number of steps in the alignment process and the order of the steps may vary depending on the stitching requirements for a particular shoe or application. For example, while the wingtip shoe described with respect to FIGS. 2–9 employs a single template, other shoe designs or other applications may use two or more templates and may thus require additional part and template alignment steps. Similarly, while the wingtip example places the template over the pallet before positioning the upper parts, it is possible in some embodiments to place the template over the pallet after positioning the upper parts and use either the lower parts or alignment marks on the pallet to position the upper layer of work pieces over the lower layer.

Figure 5:
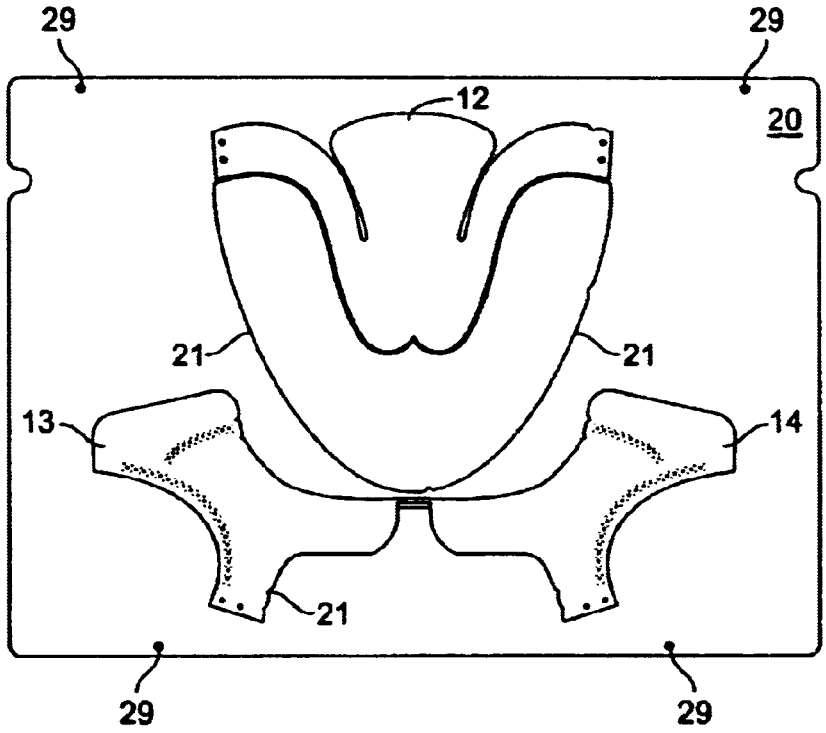
FIG. 5 is a top plan view of the pallet shown in FIG. 3 having work pieces 12, 13 and 14 arranged thereon.
Figure 6:
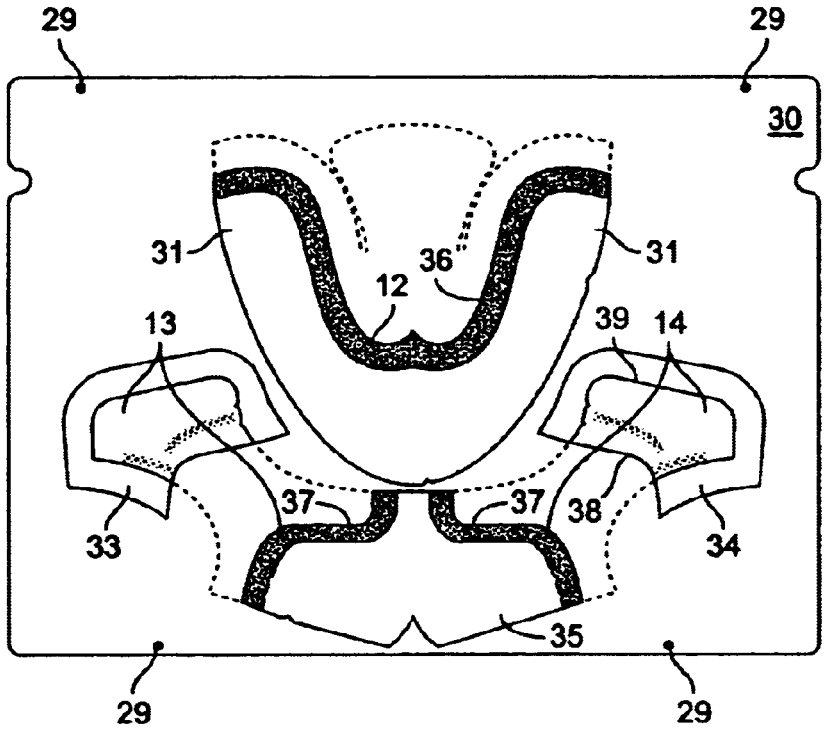
FIG. 6 is a top plan view of the template shown in FIG. 4 positioned over the pallet shown in FIG. 5.

As shown in FIG. 5, in the first step of the alignment process of the wingtip shoe, an appropriate low-adhesion water-based cement (something that allows the work pieces to be subsequently removed from the pallet without damaging the pieces) is sprayed onto the pallet and work pieces 12, 13 and 14 (shown as shaded in FIG. 5) are placed on pallet 20 using plotted lines 21 that outline the positions of the work pieces to properly align the pieces (FIG. 1, step 3). In other embodiments, an appropriate cement is applied to the work pieces in addition to or instead of the pallet. Next as shown in FIG. 6, template 30 is placed on top of pallet 20 and aligned by four positioning pins passing through the four locating holes 29 (FIG. 1, step 4). At this stage of the stitching process, parts of pieces 12, 13 and 14 (the shaded portions in FIG. 6), which were already placed on the pallet during step 3, can be seen through template windows 31, 33, 34 and 35. For reference, the portions of pieces 12, 13 and 14 that cannot be seen in FIG. 6 because they are under template 30 are shown in dotted lines. In some embodiments, pallet 20 is also made from a material that has a color selected to contrast with the color of the work pieces. Thus, in such embodiments, in addition to edge 38 edge 39 is also clearly visible to the machine-vision sewing machine during the stitching process.

Figure 7:
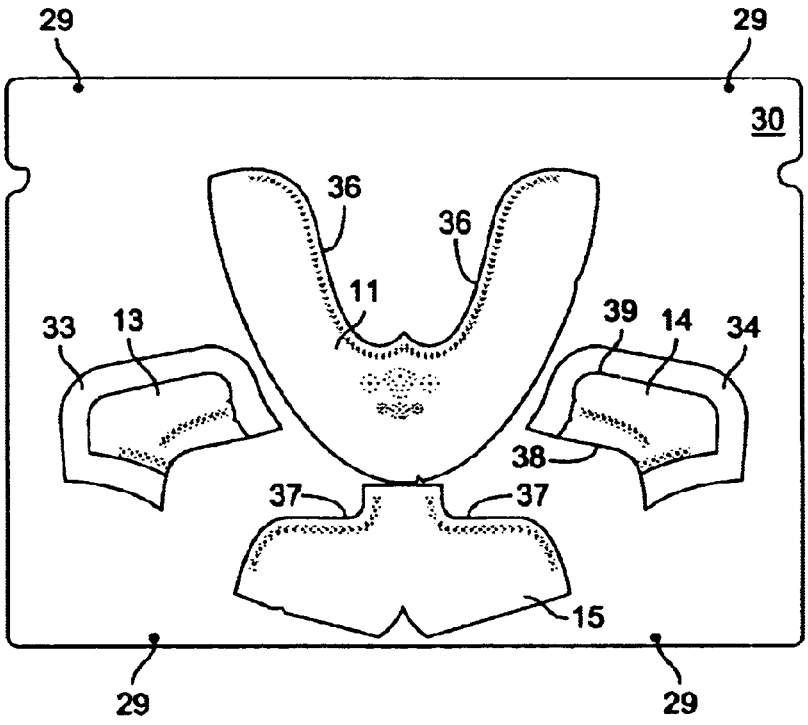
FIG. 7 is a top plan view of the template shown in FIG. 6 having work pieces 11 and 15 arranged thereon.

Referring to FIG. 7, work pieces 11 and 15 are then positioned on the pallet using the edges 36 and 37 of the cut out windows 31 and 35, respectively, to properly align the pieces. Work pieces 11 and 15 may be shed to template 30 using a technique similar to the one used to place work pieces 12, 13 and 19 on pallet 20. The boundary between edges 36 and 37 of the white template and black leather work pieces 11 and 15 creates a clear contrast between the parts that can be used by the machine-vision sewing machine during the stitching process. Windows 33 and 34 in the positioning template allow the vision system to see the outline of parts 13 and 14 already positioned on the pallet 20. Being able to detect parts 13 and 14 through windows 33 and 34 assists the machine-vision sewing machine in recognizing the orientation of the parts and pallet.

After all the work pieces and the template are properly positioned on the pallet, the pallet is loaded into the computer controlled vision-aided stitching machine, e.g., a See-N-Sew stitching machine manufactured by Orisol Ltd. (FIG. 1, step 6), and the work pieces are stitched (FIG. 1, step 7). The pallet may be positioned correctly within the stitching machine by means of the four (4) punch holes 29 in the corners of the pallet. In one embodiment, the computer-controlled vision-aided stitching begins stitching the parts according to a pre-programmed sequence of stitch line trajectories, using the position of the templates to determine starting and stopping points, and to align and correct the alignment of those stitch line trajectories.

Figure 8:
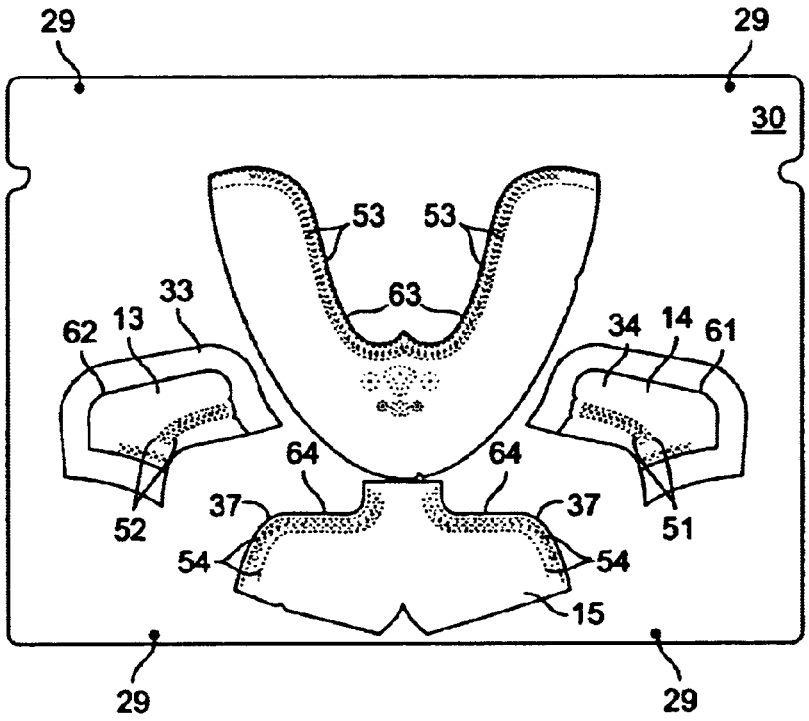
FIG. 8 shows the stitching and decorative lines stitched on the work pieces arranged as shown in FIGS. 5 and 7 after the pallet/template stack is loaded into a machine-vision stitching system.

Referring to FIG. 8, the machine-vision stitching machine stitches paths 51, 52, 53 and 54 on work pieces 14, 13, 11 and 15, respectively. In this wingtip shoe application, stitching lines 53 attach upper work piece 11 to lower work piece 12; stitching lines 54 attach upper work piece 15 to lower work pieces 13 and 14; and stitching lines 51 and 52 are for decorative purposes. The contrast between the black leather work pieces and white template 30 (especially when illuminated under a black light as discussed below) is especially clear and detectable by the machine's vision system. Thus, little programming is required to recognize the boundaries between the templates and work pieces. For the most part, there is one "standard" light setting for all sizes and all materials, when "capturing" or trying to recognize the boundaries. However, under edge-recognition vision-guided stitching systems, extensive programming and manipulation of the various lighting parameters may be required to "capture" a distinct line for each size of a shoe style and for each material or material color (even for the same size shoe pattern).

In one embodiment stitching is done by following predetermined stitching paths that are generally aligned with and offset from various edges of the template. The predetermined stitching paths represent the expected location of the desired stitching paths and can be output from the CAD/CAM pattern file. Each stitching path is typically associated with one or more edges from one or more templates. The sewing machine uses its machine vision to correct stitching paths as necessary or appropriate to better follow the perimeter of the associated template edge. The machine-vision capability can be used by scanning the work piece prior to stitching to create a data file representative of the stitching line and then modifying the data file representing the predetermined stitching path based on a comparison of this data file to the stitching path data file. Alternatively, the machine-vision capability can be used to detect the template during the stitching operation and modify the stitching path in real time if it is determined that the path does not follow the boundary between the template and the work piece. In still another embodiment, the predetermined stitching path can be represented by general instructions such as start stitching from a location 2 mm inside a first comer of a template, stitch along the template's edge (1 mm offset) to within 3 mm of a second corner of the template and then stop and stitch a second thread using the same stitching path but offset 3 mm from the template's edge. Having been so described, such programming is within the capabilities of a person of skill in the art.

Figure 9:
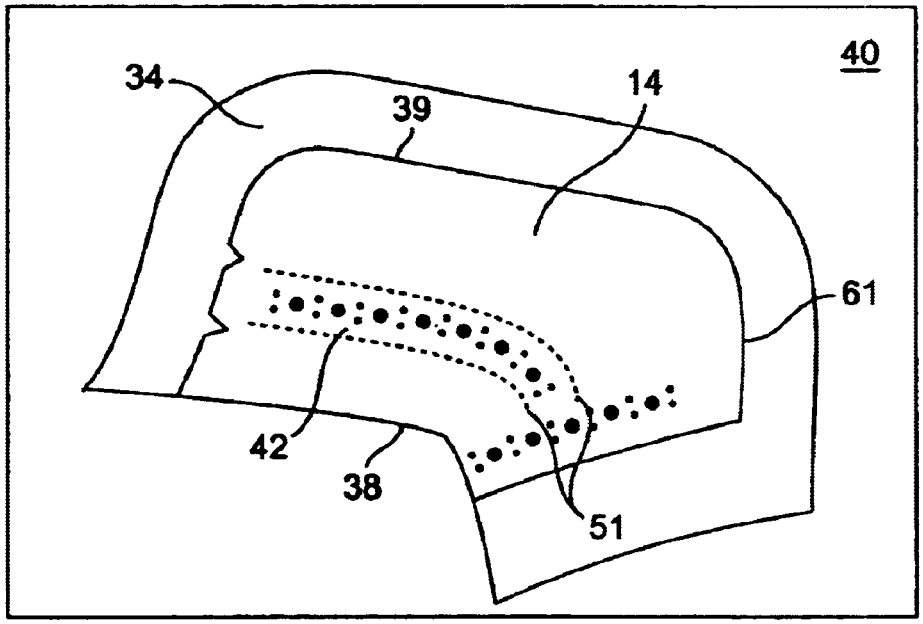
FIG. 9 is an enlarged view of area 40 shown in FIG. 8.

FIG. 9 is an enlarged view of area 40 shown in FIG. 8. Shown in FIG. 9 is work piece 14 positioned under window 34 of template 30. Also shown in FIG. 9 are two parallel desired stitching paths 51 for decorative thread. Paths 51 are offset, e.g., 1 mm above and below, from a row of perforated holes 42 in work piece 14. In this example, the sewing system is pre-programmed with stitching commands to stitch all the necessary paths to attach the work pieces to each other and stitch decorative threading (stitching lines 51, 52, 53 and 54 in FIG. 8). Thus, after being loaded in the machine-vision sewing system, the system begins to stitch according to its program. When the portion of the program that stitches lines 51 is reached, the sewing system detects the orientation of part 14 by detecting the boundary between edge 38 of template 30 and underlying work piece 14. To the extent that the data representing the pre-programmed stitching paths varies from path 51 shown in FIG. 9, the sewing system can adjusts its stitching path to follow paths 51 as referenced from edge 38 of the template. When stitch paths 51 are completed, the sewing system starts stitching the next pre-programmed stitch path, by referencing an appropriate template edge. For example, the machine may stitch stitching paths 54 by referencing edge 37 of template 30. The same can be done for other desired stitching paths as defined by edges of other templates.

After, stitching is completed, the pallet is removed from the sewing system and the work pieces and template are separated from the pallet (FIG. 1, step 8. The work pieces are then ready for the next step in the shoe manufacturing process.

As previously mentioned, vision-aided sewing machines previously known to the inventors use edge detection routines to follow the stitching path and adjust/correct for deviations that may be required in the path. In contrast, the present invention uses the machine-vision capability of the sewing machine to detect the orientation of work pieces with respect to a template. Having the machine-vision sewing machine focus on the boundary between selected edges of the template and work pieces as opposed to just an edge of a work piece being stitched greatly simplifies the vision-assisted stitching operation and increases the accuracy of the operation. Previous computer-controlled machine-vision sewing machines required numerous lights placed at a variety of angles to maximize the ability of the machine to detect the work piece edge. Edge detection is a complicated process, however, and slight variations in the lighting conditions, work piece characteristics (e.g., color of the leather or other factors may cause the edge detection software to not function properly, and may require further programming and manipulation.

In contrast, programming the computer-controlled, vision-aided sewing machine to detect the boundary between a work piece and contrasting template is relatively simple. As previously described, the template should be made from a material having a high contrast with respect to the work piece material. For example, a black template provides excellent contrast on a light colored work piece. Similarly, a white template provides good contrast on a dark colored work piece.

In order to better detect the boundaries between the a template and a work piece in some embodiments, the computer controlled machine vision sewing machine includes ultraviolet lamps instead of standard light bulbs that may be used other embodiments. Certain embodiments turn the camera's aperture setting down to reduce light and may also include a mechanism to block ambient light from the stitching area (e.g., draping a dark curtain around the stitching area). The inventors have found that one (1) ultraviolet light source, using a high pressure 100 watt mercury vapor short arc lamp with bandpass filters to permit the transmission of ultraviolet light while locking most of the visible light, and outfitted with two (2) flexible liquid filled light guides to deliver the light from the lamp to the stitching area, placed in a See-N-Sew stitching machine manufactured by Orisol Ltd. can be used in place of twenty (20) or more regular light bulbs recommended by the manufacturer for use in edge detection.

In order to better appreciate the difference in programming of the vision aided stitching machine afforded by the present invention, consider one embodiment of the present invention where the vision-aided stitching machine is a Sew-N-See stitcher manufactured by Orisol. A See-N-Sew stitching machine operated to detect the edge of a work piece without the benefit of the present invention includes more than twenty (20) light bulbs positioned in two (2) layers of circles above the stitching area. These two (2) layers are in fact arranged in three (3) different configurations, which the operator has to choose from when "programming" the machine's lighting. These three (3) configurations include an all bottom ring; an all top ring and a combination of lights from the top and bottom rings. Aside from selecting one of these three (3) configurations, the operator also decides whether to turn on or turn off individual lights in the configuration chosen.

It is up to the machine operator to "program" these lights for each frame taken by the vision system. There may be something in the neighborhood of fifty (50) or more frames taken for a given stitching program. That is, to stitch the parts aligned in a typical pallet, there are more than fifty (50) frames captured by the vision system. The operator must "program" the lighting conditions for each of these fifty-plus (50+) frames, one-by-one. By "programming", the operator must determine which configuration of lighting to use and then which lights are turned ON and which are left OFF, with the intent to create the best lighting direction to accent the edge of the material for detection of that edge for each and every frame. In addition to this, the operator must adjust the intensity of the light for each frame. For the Orisol machine, the intensity of the light is really the opening of the camera aperture.

It is not unusual for an operator to spend a minute or more on each frame. Also, it is normal to have to come back, after doing "dry-run" testing of a programmed lighting, and have to make adjustments to lighting again, frame-by-frame addressing any problems that may show up in the edge detection process.

In addition to all the adjustments noted above, the operator must decide on one of three (3) different edge detection algorithms to use as part of the lighting adjustment for each frame. These algorithms include: shadow; white; or contrast. The SHADOW algorithm detects the edge when going from light to dark; the WHITE algorithm detects the edge between dark and light; and the CONTRAST is like WHITE but with some subtleties on how and where the light comes from. Once the operator decides on the algorithm, the programming is input into the stitching machine and the machine is ready for use.

When operated according to some embodiments of the present invention, the twenty-plus (20+) bulbs of the See-N-Sew machine are removed. In one embodiment in their place is positioned one ultraviolet light source (e.g., a high pressure 100 Watt mercury vapor short arc lamp manufactured by EFOS, Inc.) that feeds light to the workplace via two light guides (e.g., dual path liquid filled light guides with quartz tip clad in stainless steel also manufactured by EFOS, Inc). In another embodiment the light guides are not necessary. Instead, a fluorescent high frequency lineal light source with two 6 Watt black light fluorescent bulbs manufactured by Edmund Industrial Optics is used. In each of these embodiments, during line detection the light(s) are kept always ON, it is not necessary to change the intensity and the algorithm can be set to SHADOW. Changes to the program are not necessary on frame-by-frame bases. Of course, the invention is not limited to these particular lights sources or lighting types. Other embodiments may use other lights sources as may be determined by a person of skill in the art.

Having described the present invention with respect to the manufacture of one particular style of custom shoes, a person of skill in the art will recognize that the invention has much broader applicability. For example, the invention may be used to produce any style and type of shoe including shoes with far fewer sizes than custom shoes. Additionally, the present invention may be used to stitch work pieces other than those used for the assembly of shoes. For example, the invention may be used to stitch purses, jackets, gloves and other leather goods and may be also used to stitch similar goods made of synthetic materials and materials other than leather.

Figure 10:
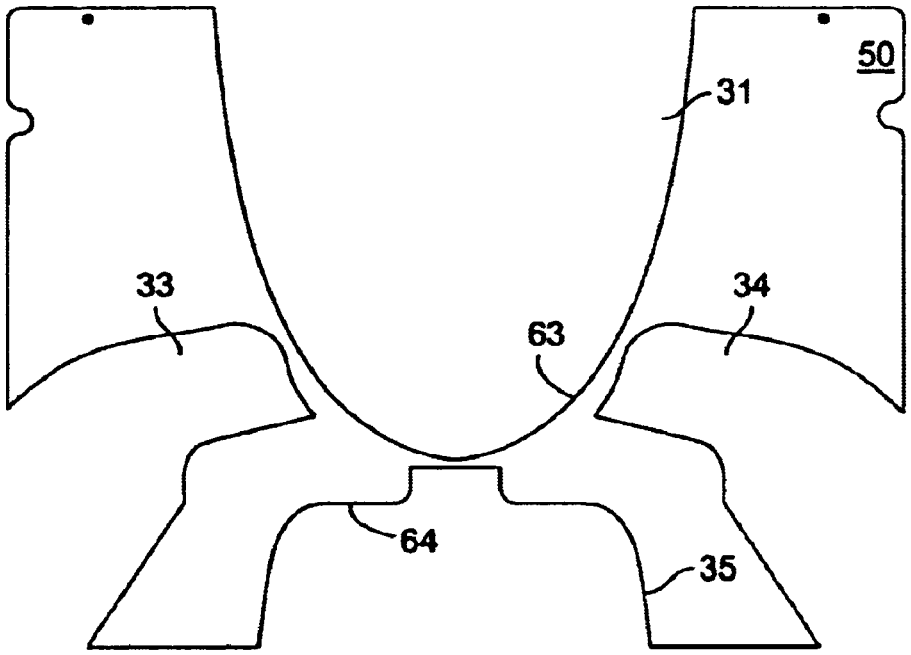
FIG. 10 is a top view of an exemplary template that may be used to facilitate alignment of work pieces according to another embodiment of the invention.

Furthermore, the invention has been illustrated with specific embodiments by way of example only. A person of skill in the art will recognize that many alternative and equivalent methods of practicing the present invention exist. For example, while template 30 is shown in the example as being approximately the same size and shape as palate 20 with a number of included windows, template 30 can be any size or shape that helps the machine-vision sewing machine detect and orient the work pieces to be stitched. FIG. 10 is an example of a template 60 with out any windows that can be used to align work pieces 11 and 15 (along edges 63 and 64, respectively) and orient the sewing machine in a manner similar to template 30. Also, alignment lines 21 on pallet 20 do not need to provide a complete outline of the work pieces to be placed on the pallet. In other embodiments, alignment lines 21 correspond to only select edges of the work pieces. As another example, while step 7 is illustrated as stitching various work pieces together using a See-N-Sew computer stitching machine manufactured by Orisol Ltd., other computer-controlled, vision-aided stitching machines can be used to sew the work pieces or other appropriate machines can be specifically manufactured for this step. A vision-aided stitching machine (a stitching machine having a machine-vision system) within the context of the present invention refers to any machine that can detect the boundary between a template and work piece being stitched because of their contrasting colors. Similarly, other methods of cutting the work pieces (e.g., with a water jet) and aligning the work pieces can be used. Also, the present invention can be used in the manufacture of shoes from digital patterns that are generated from physical rather than digital lasts. The present invention is only intended to be limited by the claims listed below.

What is claimed is:

1. A method of stitching a work piece, said method comprising:

providing a first work piece having a first edge along which a stitch is to be made;

providing a template having an edge that corresponds generally to at least a portion of the first edge of the first work piece, the template having a color selected to contrast with a color of the first work piece;

placing the first work piece against the template so that the first edge of the first work piece abuts at least a portion of the edge of the template;

using a computer-controlled sewing machine having a machine-vision capability to stitch along a path that corresponds generally to a boundary between the first edge of the first work piece and the edge of the template, wherein the computer-controlled sewing machine can adjust its stitching path in response to detecting the template; and separating the first work piece from the template.

2. The method of claim 1 wherein the template is placed over a pallet prior to placing the first work piece against the template and the separating step further comprises separating the first work piece from the pallet.

3. The method of claim 2 wherein the pallet includes at least a second work piece positioned thereon and the template is placed over the second work piece.

4. The method of claim 3 wherein the first edge of the first work piece is placed over a portion of the second work piece and the first work piece is stitched to the second work piece.

5. The method of claim 1 wherein said work piece is made from a material having a dark color and said template is made from a material having a light color.

6. The method of claim 5 wherein said template is white.

7. The method of claim 1 wherein said machine-vision sewing machine includes an ultraviolet light.

8. The method of claim 1 wherein the stitching path is offset a predetermined distance from the boundary.

9. The method of claim 1 wherein said work piece is part of a shoe.

10. The method of claim 9 wherein said work piece has a thickness of at least 1.0 mm.

11. A method for attaching a first work piece to a second work piece, the method comprising:

arranging the second work piece on a pallet;

arranging the first work piece and a template made from a material having a color that contrasts with a color of the first work piece over the pallet so at least a portion of the first work piece overlies the second work piece and so that an edge of the template overlies or abuts at least a portion of the first work piece in an area corresponding to a desired stitching path;

transferring the pallet to a computer-controlled, machine-vision sewing machine and stitching the first work piece to the second work piece using the sewing machine's vision capabilities to detect a boundary between the edge of the template and the first work piece and stitching the desired stitching path in reference to the detected boundary; and thereafter, separating the first and second work pieces from the pallet and the template.

12. The method of claim 11 wherein the first and second work pieces are part of a shoe.

13. The method of claim 11 wherein the second work piece is secured to the pallet using a low-adhesion glue.

14. The method of claim 11 wherein the machine-vision sewing machine includes an ultraviolet light.

15. The method of claim 11 wherein the desired stitching path is offset a predetermined distance from the boundary.

16. The method of claim 11 wherein:

the sewing machine is programmed to stitch along a predetermined path stored in a first data file, the predetermined path corresponding generally with at least a portion of the boundary between the edge of the template and the first work piece;

the machine-vision system of the sewing machine scans the pallet to create a second data file including data representing at least a portion of the boundary between the edge of the template and the first work piece; and the sewing machine references both the first and second data files to stitch the first work piece to the second work piece.

17. The method of claim 11 wherein:

the sewing machine is programmed to stitch along a predetermined path stored in a first data file, the predetermined path corresponding generally with at least a portion of the boundary between the edge of the template and the first work piece;

the machine-vision system of the sewing machine is used to detect the boundary between the edge of the template and the first work piece while the sewing machine is stitching along the predetermined path; and the predetermined stitching path can be altered in response to detecting the boundary.

18. A process for manufacturing shoes, the process comprising:

using a computer-controlled apparatus to cut first and second work pieces from a first piece of material of a first color according to a predetermined pattern stored in a computer-readable medium;

using a computer-controlled apparatus to cut a pallet that includes one or more appropriately placed openings that allow for stitching and to plot alignment marks on the pallet for aligning work pieces to be stitched thereon, wherein the openings are cut and the alignment marks are drawn according to predetermined patterns stored in the computer-readable medium;

using a computer-controlled apparatus to cut a template from a second piece of material of a second color selected to contrast with the first color according to a predetermined pattern stored in the computer-readable medium, the template including at least one edge that corresponds generally to a desired stitching path;

arranging the first work piece over the pallet using the alignment marks so at least a portion of the first work piece overlies one of the openings;

placing the template over the pallet;

arranging the second work piece over the pallet so that an edge of the second work piece abuts at least a portion of the template edge;

after the first and second work pieces and template are placed over the pallet, using a computer-controlled sewing machine to stitch the second work piece to the first work piece along a programmed sewing path that corresponds generally to at least a portion of the template edge, wherein the computerized sewing machine includes a machine-vision capability enabling it to adjust its sewing path in response to the boundary between the template and the second work piece; and separating the stitched first and second work pieces from the pallet and template.

19. The method of claim 18 wherein the pallet includes a plurality of locating holes that facilitate positioning of the pallet in the sewing machine prior to the stitching operation.

20. The process of claim 19 wherein the template includes a plurality of locating holes that align the template over the pallet.

21. The process of claim 19 wherein the second work piece is placed over the pallet after the template is placed over the pallet and the template is used to align the second work piece on the pallet.

22. The process of claim 18 further comprising digitizing a pair of feet with a scanning device to create a digitized data file and comparing the digitized data file to a plurality of digitized lasts using an algorithm to select a best matching digital last.

23. The process of claim 22 wherein the predetermined patterns used to cut the first and second work pieces, the pallet and the template and draw alignment marks on the pallet are generated from the best matching digital last.

24. The process of claim 18 wherein the programmed sewing path is offset a predetermined distance from the boundary.

25. The process of claim 18 wherein the sewing machine includes an ultraviolet light.

* * * * *